US006742261B2

(12) United States Patent
Ho

(10) Patent No.: US 6,742,261 B2
(45) Date of Patent: Jun. 1, 2004

(54) UTILITY KNIFE

(76) Inventor: Yen-Yu Ho, No. 219, Sec. 3, Wuchiuan W. Rd., Nantuen Chiu, Taichung (TW), 408

( * ) Notice: Subject to any disclaimer, the term of this patent is extended or adjusted under 35 U.S.C. 154(b) by 0 days.

(21) Appl. No.: 10/401,725

(22) Filed: Mar. 31, 2003

(65) Prior Publication Data

US 2003/0196331 A1 Oct. 23, 2003

(30) Foreign Application Priority Data

Apr. 22, 2002 (TW) ..... 91205406 U

(51) Int. Cl.[7] ..... B26B 1/08
(52) U.S. Cl. ..... 30/162; 30/125
(58) Field of Search ..... 30/125, 162, 335

(56) References Cited

U.S. PATENT DOCUMENTS 5,940,970 A * 8/1999 D'Ambro et al. ..... 30/125
6,249,975 B1 * 6/2001 Lin ..... 30/162
6,357,120 B1 * 3/2002 Khachatoorian et al. ..... 30/162
6,374,497 B1 * 4/2002 Sun ..... 30/162
6,415,514 B1 * 7/2002 Chun ..... 30/162
6,446,340 B1 * 9/2002 Ping ..... 30/125
6,513,246 B2 * 2/2003 Ping ..... 30/125
6,553,674 B1 * 4/2003 Budrow ..... 30/162

* cited by examiner

*Primary Examiner*—Hwei-Siu Payer
(74) *Attorney, Agent, or Firm*—Browdy and Neimark, P.L.L.C.

(57) ABSTRACT

A utility knife includes a handle having a first casing and a second casing, a blade holder slidably received in a chamber of the handle and having a supporting portion at where a blade is attached, wherein the supporting portion has an elastic piece with a lock portion to be engaged with recesses of the blade and a pushing portion at a top of the lock portion, and disassembling member for pressing the elastic piece of the blade holder to disassemble the blade from the blade holder. The second casing has a blade room at where relates to the blade holder to receive reserved blades therein, an elastic member in the blade room to push the reserved blade toward the blade holder and a post to push the pushing portion of the elastic piece of the blade holder.

10 Claims, 5 Drawing Sheets

UTILITY KNIFE

BACKGROUND OF THE INVENTION

1. Field of the Invention

The present invention relates generally to a cutting tool, and more particularly to a utility knife, which replaces the blade in an easy and safe way.

2. Description of the Related Art

A conventional utility knife had a handle, a blade holder movably installed in the handle and a blade secured on the blade holder. The blade holder was moved to drive the blade out of the handle to cut something or draw the blade in the handle to be stored safely. The blunt blade, however, has to be replaced in an inconvenient way. The handle needs to be disassembled first and then the blade is taken out from the blade holder. A new blade, it might be stored in the handle, is installed on the blade holder and the handle is assembled again. The step of replacing the blade is inconvenient and not safety. It might slash user, especially to a children.

SUMMARY OF THE INVENTION

The primary objective of the present invention is to provide a utility knife, which has an easier and faster way to replace blade.

The second objective of the present invention is to provide a utility knife, which has a safe way to replace blade.

According to the objectives of the present invention, a utility knife comprises a handle having a first casing and a second casing coupled, a chamber between the first and second casings, an elongated slot at a top thereof communicated with the chamber and a opening at a front end thereof communicated with the chamber, a blade holder slidably received in the chamber of the handle and having a supporting portion at where a blade is attached, at least a flange projected from the supporting portion to be against the blade, an arm projected from the supporting portion and a button at a distal end of the arm and extended out of the handle via the slot, wherein the blade has at least a recess at a top thereof and the supporting portion of the blade holder has an elastic piece with a lock portion at a distal end thereof to be engaged with the recess of the blade and a pushing portion at a top of the lock portion, and means for pressing the elastic piece of the blade holder to disassemble the blade from the blade holder. The second casing has a blade room at where relates to the blade holder to receive reserved blades therein, an elastic member in the blade room to push the reserved blade toward the blade holder and a post to push the pushing portion of the elastic piece of the blade holder.

DETAILED DESCRIPTION OF THE INVENTION

Figure 1:
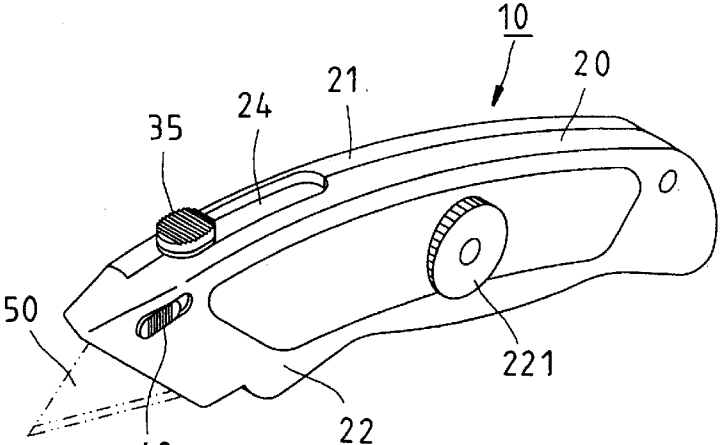
FIG. 1 is a perspective view of a preferred embodiment of the present invention.

Please refer to FIGS. from FIG. 1 to FIG. 6, a utility knife 10 of the preferred embodiment of the present invention comprises a handle 20, and blade holder 30 and disassembling means 40, wherein a blade 50 is detachably secured on the blade holder 30 which is trapezoid and has two recesses 52 at a top thereof and an edge 54 at a bottom thereof. The blade 50 is a conventional element that you can find it in the market easily.

Figure 2:
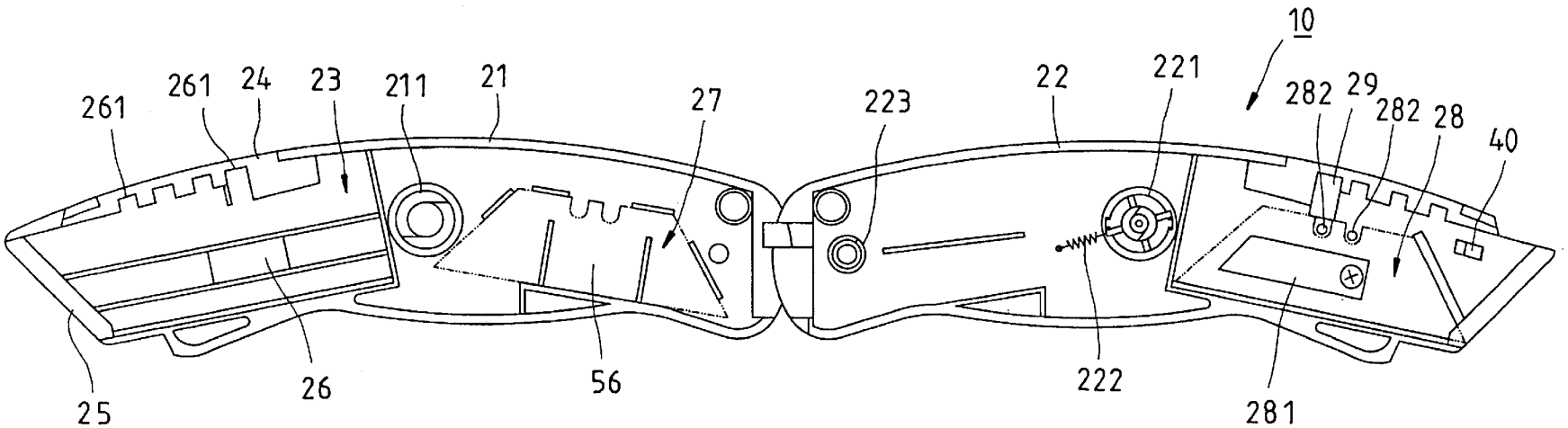
FIG. 2 is a front view of the preferred embodiment of the present invention, showing the handle being opened.
Figure 3:
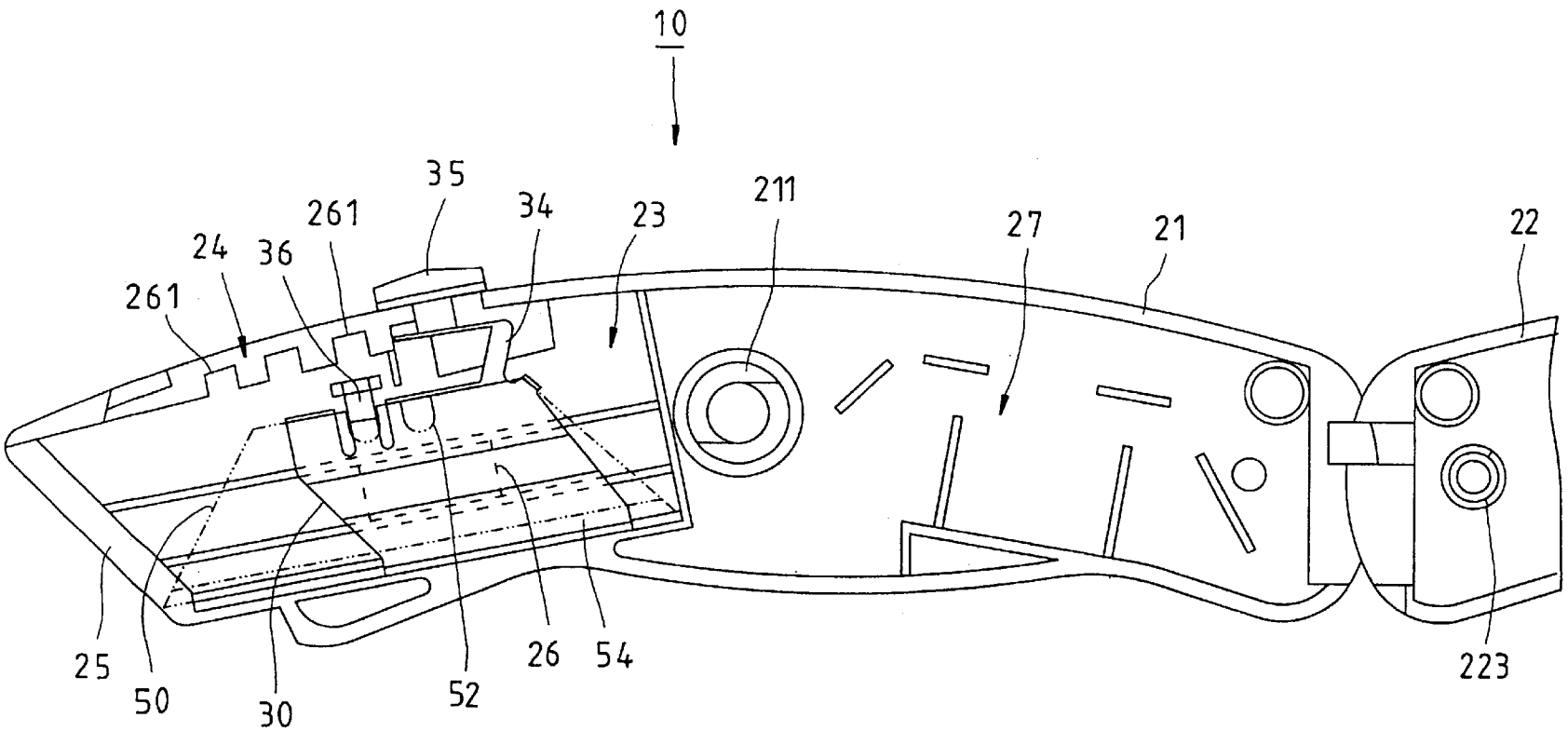
FIG. 3 is a front view of the first casing and the blade holder.
Figure 4:
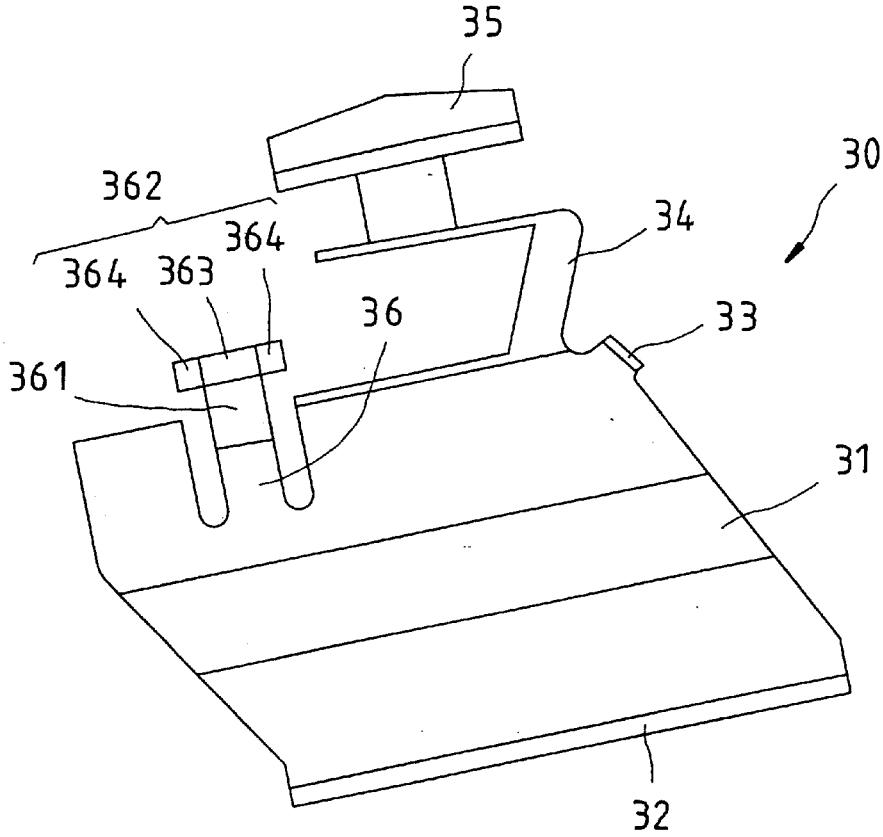
FIG. 4 is a front view of the blade holder.
Figure 5:
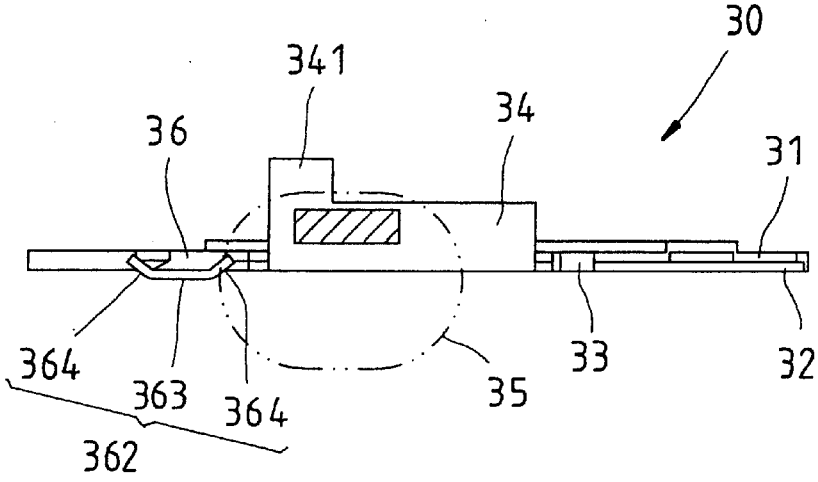
FIG. 5 is a top view of the blade holder.

The handle 20 consists of a first casing 21 and a second casing 22 to form a chamber 23 between the casings 21 and 22 when they are assembled. The handle 20 has an elongated slot 24 at a top of the chamber 23 and an opening 25 at a front end thereof. A hinge (not shown) is provided at rear ends of the casings 21 and 22 to couple the first casing 21 with the second casing 22 and make them can be turned relative to each other therefore the handle 20 can be opened (as shown in FIG. 2) or can be closed (as shown in FIG. 1). The casings 21 and 22 are respectively provided with a first fastener 211 that is a nut in the present embodiment and a second fastener 221 that is a bolt in the present embodiment to secure the casings 21 and 22 together when the handle 20 has been integrated. The second fastener 221 has a torsional spring 222 to keep the second fastener 221 in a position at where the second fastener 221 is going to engage the first fastener 211. A spring 223 is provided between the casings 21 and 22 to force the casings 21 and 22 turned away from each other while the second fastener 221 is released from the first fastener 211.

The first casing 21 has a magnetic member 26 at where the blade holder 30 is mounted to attract the blade holder 30. The first casing 21 further has a first blade room 27 adjacent to the rear end thereof to store reserved blades 56 therein and plural of positioning slots 261 at a top thereof. The second casing 22 has a second blade room 28 at where corresponds to the blade holder 30 to receives reserved blades 58 therein. The second blade room 28 has an elastic member 281 therein to push the blades 58 toward the blade holder 30 and two pins 282 running through recesses 581 of the blades 58 to position the blades 58. The second casing 22 further has a post 29 above the second blade room 28 at a distal end of which has a flat 291 and two inclined planes 292.

The blade holder 30 is slidably received in the chamber 23 having a plank-like supporting portion 31 where the blade 50 is attached, a first flange 32 projected from a bottom of the supporting portion 31 to attach a bottom end of the blade 50, a second flange 33 projected from a rear of the supporting portion 31 to attach a rear end of the blade 50, a flexible arm 34 projected from a top of the supporting portion 31 and a button 35 at a distal end of the arm 34 and extended out of the handle 20 via the slot 24. The arm 34 has a side piece 341 to be engaged with the positioning slot 261 so that the blade holder 30 is positioned at a plurality positions while it is moved. The supporting portion 31 further has an elastic piece 36 at a distal end of which has a lock portion 361 to be engaged with the recess 52 of the blade 50 so that the blade 50 is fixed on the blade holder 30. The lock portion 361 has a pushing portion 362 projected from a top thereof and the pushing portion 362 has a main plate 363 and two inclined plates 364 at opposite sides of the main plate 363 respectively. The button 35 is pressed to release the side piece 341 from the positioning slot 261 whereby the blade holder 30 can slide freely. The blade 50 is extruded out of the handle 20 via the opening 25 while the blade holder 30 is moved forward and the blade 50 is drawn into the handle 20 while the blade holder 30 is moved rearward.

The disassembling means 40 have a guiding slot 224 at a front side of the second casing 22 and a sliding block 42 slidably received in the guiding slot 224. The sliding block 42 has an inclined plane 43 at an end thereof to be against the inclined plate 364 of the elastic piece 36.

Figure 6:
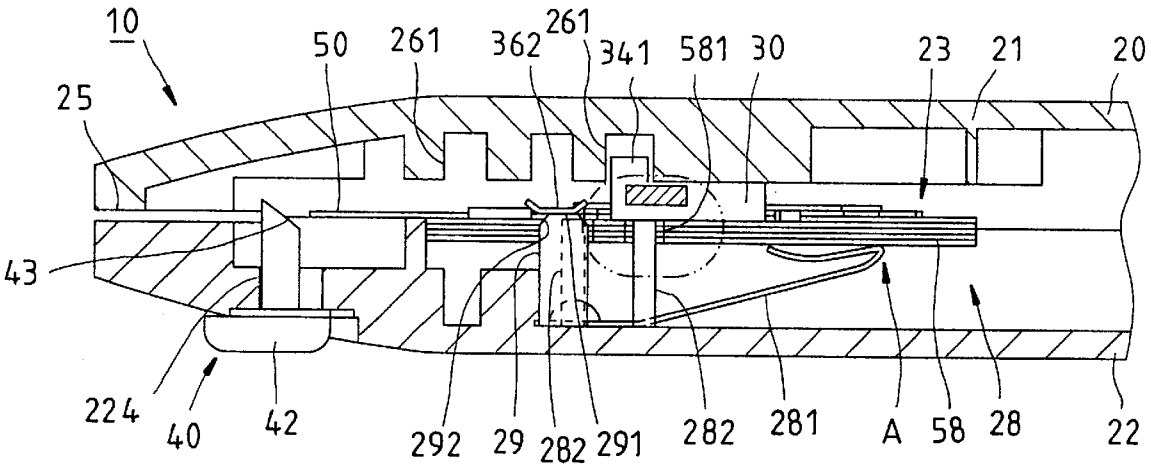
FIG. 6 is a sectional view of the preferred embodiment of the present invention, showing the first step of replacing blade.
Figure 7:
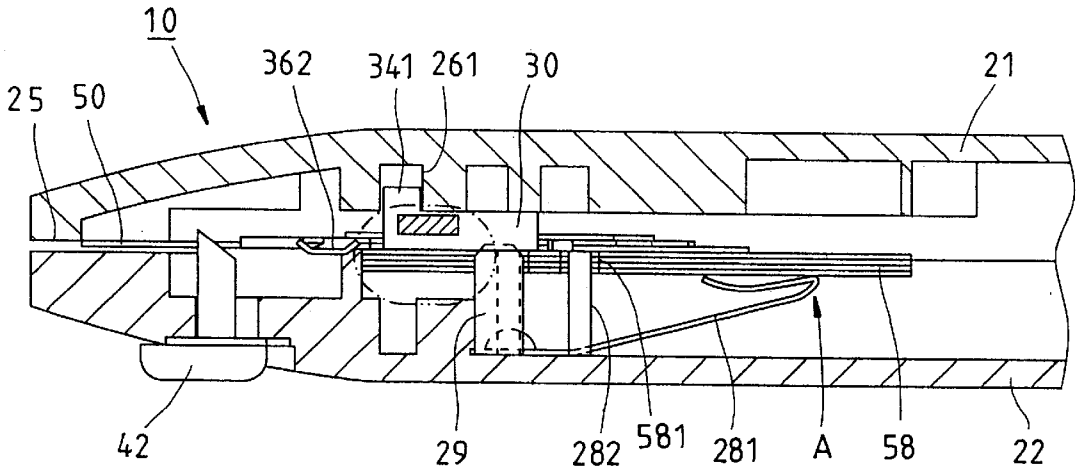
FIG. 7 is a sectional view of the preferred embodiment of the present invention, showing the second step of replacing blade.

To operate the utility knife 10 of the present invention, while the blade holder 30 is moved to a rear end of the slot 24 to draw the blade 50 totally received in the handle 20 as shown in FIG. 6, the pushing portion 362 of the elastic piece 36 is bent by the post 29 to make lock portion 361 engaged with the recess 52 of the blade 50 on the blade holder 30 only without reserved blades 58 in the second blade room 28. The blade 50 is moved outwardly while the blade holder 30 is moved to a front end of the slot 24 from the rear end thereof and the reserved blades 58 are left in the second blade room 28 still as shown in FIG. 7. The pushing portion 362 returns to a normal position while it leaves the post 29 and the lock portion 361 leaves the position to be engaged with the recesses 581 of the blades 58 so that only the blade 50 is moved with the blade holder 30. The mechanism is to prevent the blade holder from carrying two or more blades.

Figure 8:
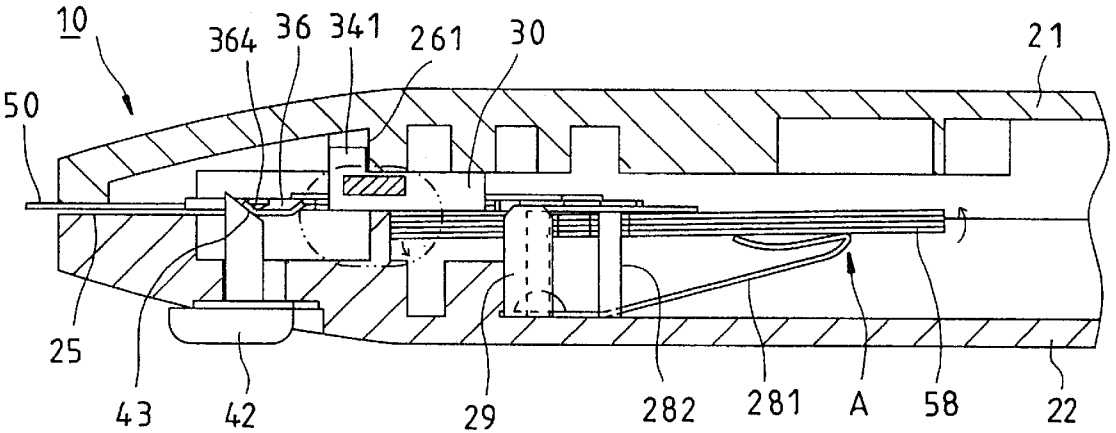
FIG. 8 is a sectional view of the preferred embodiment of the present invention, showing the third step of replacing blade.

The elastic member 281 presses the reserved blades 58 at one side thereof so that the reserved blades 58 will rotates a specific angle along the arrow shown in FIG. 8 after the blade holder 30 moves forward for a specific distance. The blade 50 is extended out of the handle 20 via the opening 25 while the blade holder 30 moves to the front end of the slot 24. The inclined plate 364 of the pushing portion 362 of the elastic piece 36 of the blade holder 30 rests against the inclined plane 43 of the sliding block 42 as shown in FIG. 8 and the pins 282 on the second casing 22 support the blade 50 such that the blade is fixedly to cut something.

To draw the blade 50 into the handle 20, the button 35 is pressed to release the side piece 341 from the positioning slot 261 of the first casing 21 and the blade holder 30 now can be moved from the front end of the slot 24 to the rear end thereof to carry the blade 50 back into the handle 20. Because of a width of the lock portion 361 of the blade holder 30 larger than a thickness of the blade, the lock portion 361 will be blocked by a front end of the reserved blade 58 while the reserved blades 58 are parallel to the blade 50. In the present invention, the reserved blades 58 is pushed by the elastic member 281 with front ends thereof lower as shown in FIG. 8, the blade holder 30 can run over the reserved blade 58 without any interference. The reserved blades 58 will be force to parallel by the blade holder 30 while the blade holder 30 is moved over a position A at where the elastic member 281 is against the blade 58.

Figure 9:
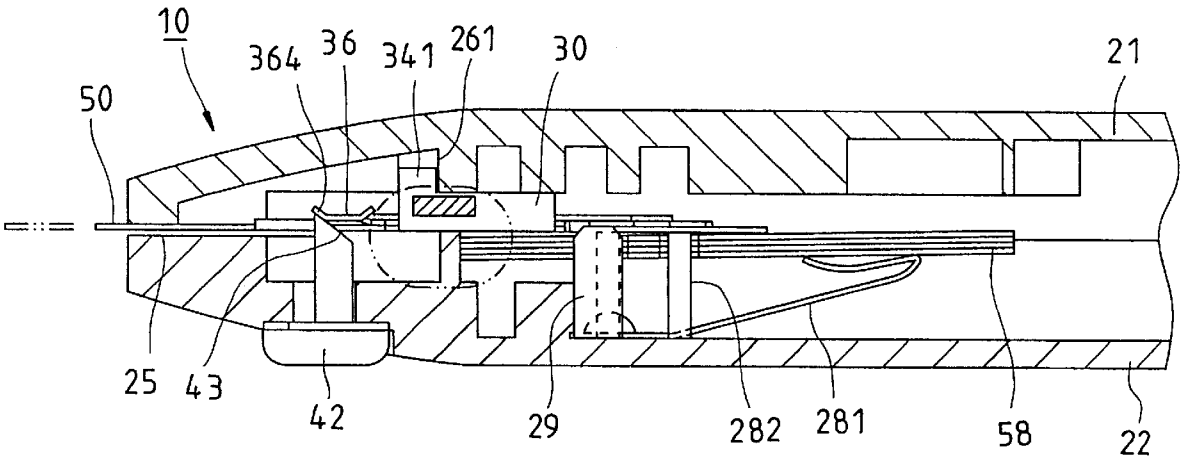
FIG. 9 is a sectional view of the preferred embodiment of the present invention, showing the fourth step of replacing blade.

As the description of above, the inclined plate 364 of the pushing portion 362 of the elastic piece 36 of the blade holder 30 rests against the inclined plane 43 of the sliding block 42 when the blade holder 30 is moved to the front end of the slot 24. The sliding block 42 is pressed rearward as shown in FIG. 9, whereby the pushing portion 362 will be bent to release the lock portion 361 from the recess 52 of the blade 50 and the blade 50 is not secured on the blade holder 30 and can be drawn out of the handle 20. The elastic piece 36 will help the sliding block 42 back to a normal position thereof while the sliding block 42 is released. And then, the button 35 is pressed to move the blade holder 30 back to the rear end of the slot 24. The inclined reserved blade 58 still return to parallel after the blade holder 30 runs over the position A. The elastic member 281 will push the blade 58 at the top attached on the blade holder 30 when the blade holder 30 arrives the rear end of the slot 24. When the blade holder 30 is moved forward again, a new blade 58 is ready for cutting.

The blade 50 of the utility knife 10 of the present invention is fixedly secured on the blade holder 30. The procedures to replace the blade are very simple, user only needs to press the slide block 42 of the disassembling means 40 to remove the old blade and move the blade holder 30 rearward, and then when the blade holder 30 is moved forward again, a new blade is ready.

The main scope of the present invention is to provide a utility knife, which replace the blade by the steps of moving the blade holder rearward and then moving it forward to get a new blade. The disassembling means 40 have many alternated structures, but no matter which kind of the structure which can achieve the function of releasing the old blade should be within the scope of the present invention.

What is claimed is:

1. A utility knife, comprising:

a handle having a first casing and a second casing coupled, a chamber between the first and second casings, an elongated slot at a top thereof communicated with the chamber and an opening at a front end thereof communicated with the chamber;

a blade holder slidably received in the chamber of the handle and having a supporting portion at where a blade is attached, at least one flange projected from the supporting portion to be against the blade, an arm projected from the supporting portion and a button at a distal end of the arm and extended out of the handle via the slot, wherein the blade has at least a recess at a top thereof and the supporting portion of the blade holder has an elastic piece with a lock portion at a distal end thereof to be engaged with the recess of the blade and a pushing portion at a top of the lock portion; and means for pressing the elastic piece of the blade holder to disassemble the blade from the blade holder;

wherein the second casing has a blade room at where relates to the blade holder to receive reserved blades therein, an elastic member in the blade room to push the reserved blades toward the blade holder and a post to push the pushing portion of the elastic piece of the blade holder.

2. The utility knife as defined in claim 1, wherein the first and second casings are pivotally coupled with each other at rear ends thereof and respectively provide a first fastener and a second fastener thereon to secure the first and second casings.

3. The utility knife as defined in claim 2, wherein the second fastener has a spring thereon to keep the second fastener at an initial position while there is no force exerted on the second fastener.

4. The utility knife as defined in claim 1, wherein said at least one flange comprises a first flange projecting from a bottom of the supporting portion to be against a bottom end of the blade and a second flange projecting from a rear of the supporting portion to be against a rear end of the blade.

5. The utility knife as defined in claim 1, wherein the pushing portion has a main plate and two inclined plates at opposite sides of the main plate respectively.

6. The utility knife as defined in claim 5, wherein the means comprises a guiding slot at the second casing and a sliding block slidably received in the guiding slot, wherein the sliding block has an inclined plane at an end thereof to be against the inclined plates of the elastic piece of the blade holder.

7. The utility knife as defined in claim 1, wherein the second casing has at least a pin running through a recess of the reserved blade and against the blade attached on the blade holder with a distal end thereof.

8. The utility knife as defined in claim 1, wherein the first casing has a blade room to receive reserved blade therein.

9. The utility knife as defined in claim 1, wherein the first casing has a magnetic member at where relates to the blade holder to attract the blade holder.

10. The utility knife as defined in claim 1, wherein the arm of the blade holder has a side piece to be engaged with positioning slots on the first casing to position the blade holder at specific positions.

* * * * *